US011021682B1

(12) United States Patent
Hoyle

(10) Patent No.: US 11,021,682 B1
(45) Date of Patent: Jun. 1, 2021

(54) DRAIN-UNCLOGGING STRAW

(71) Applicant: Elicia Hoyle, Cranston, RI (US)

(72) Inventor: Elicia Hoyle, Cranston, RI (US)

( * ) Notice: Subject to any disclaimer, the term of this patent is extended or adjusted under 35 U.S.C. 154(b) by 282 days.

(21) Appl. No.: 16/285,404

(22) Filed: Feb. 26, 2019

(51) Int. Cl.

| | |
|---|---|
| ***C11D 1/00*** | (2006.01) |
| ***C11D 17/04*** | (2006.01) |
| ***C11D 11/00*** | (2006.01) |
| ***C11D 7/10*** | (2006.01) |
| ***C11D 7/06*** | (2006.01) |
| ***C11D 7/02*** | (2006.01) |
| ***C11D 7/28*** | (2006.01) |

(52) U.S. Cl.
CPC ..... *C11D 17/044* (2013.01); *C11D 7/02* (2013.01); *C11D 7/06* (2013.01); *C11D 7/10* (2013.01); *C11D 7/28* (2013.01); *C11D 11/0023* (2013.01)

(58) Field of Classification Search
CPC ..... C11D 17/044; C11D 7/02; C11D 11/0023
See application file for complete search history.

(56) References Cited

U.S. PATENT DOCUMENTS

| | | | | |
|---|---|---|---|---|
| 3,525,426 | A * | 8/1970 | Miller | B08B 9/051 134/93 |
| 3,875,083 | A * | 4/1975 | Murtaugh | C09K 5/18 510/196 |
| 4,058,474 | A * | 11/1977 | Keyes | C11D 3/0052 510/196 |
| 4,084,305 | A * | 4/1978 | Chang | B25B 27/023 29/261 |
| 5,718,681 | A | 2/1998 | Manning | |
| D578,333 | S | 10/2008 | Baron | |
| 9,365,808 | B2 | 6/2016 | Sternberg | |
| 2005/0142252 | A1 | 6/2005 | Brown | |
| 2008/0171110 | A1* | 7/2008 | Stuart | B65D 85/812 426/82 |
| 2009/0110618 | A1* | 4/2009 | Dombrowski | A61L 2/23 422/291 |
| 2011/0215020 | A1 | 9/2011 | Rapp | |
| 2018/0098652 | A1 | 4/2018 | Ecseri | |

FOREIGN PATENT DOCUMENTS

| | | | |
|---|---|---|---|
| DE | 202009012547 | | 2/2010 |
| GB | 213284 | * | 8/1924 |

* cited by examiner

*Primary Examiner* — Necholus Ogden, Jr.
(74) *Attorney, Agent, or Firm* — Kyle A. Fletcher, Esq.

(57) ABSTRACT

The drain-unclogging straw is a chemical device. The drain-unclogging straw comprises a drain clearing device and a domestic DWV system. The domestic DWV system further comprises a drain. The drain contains biochemically-generated material that inhibits the flow of wastewater through the drain. The drain clearing device is a chemical device that is formed as a kit. The drain clearing device breaks the biochemically-generated material down into components that will flow through the drain. The drain clearing device comprises a straw and a chemical compound. The chemical compound is in a solid phase. The straw contains the chemical compound. The straw is placed directly in the drain. Once in the drain, the straw dissolves such that the chemical compound is released into the drain. The chemical compound chemically interacts with the biochemically-generated material such that the biochemically-generated material is broken down.

17 Claims, 3 Drawing Sheets

DRAIN-UNCLOGGING STRAW

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of transportation and containers including containers adapted for non-packaging purposes after removal of the contents, more specifically, a container for packaging articles intended to be mixed with a liquid. (B65D2081/001)

SUMMARY OF INVENTION

The drain-unclogging straw is a chemical device. The drain-unclogging straw comprises a drain clearing device and a domestic DWV system. The domestic DWV system handles wastewater generated from domestic plumbing systems. The domestic DWV system further comprises a drain. The drain contains biochemically-generated material that inhibits the flow of wastewater through the drain. The drain clearing device is a chemical device that is formed as a kit. The drain clearing device breaks the biochemically-generated material down into components that will flow through the drain. The drain clearing device comprises a straw and a chemical compound. The chemical compound is in a solid phase. The straw contains the chemical compound. The straw is placed directly in the drain. Once in the drain, the straw dissolves in water trapped in the drain such that the chemical compound is released into the drain. The chemical compound chemically interacts with the biochemically-generated material such that the biochemically-generated material is broken down.

These together with additional objects, features and advantages of the drain-unclogging straw will be readily apparent to those of ordinary skill in the art upon reading the following detailed description of the presently preferred, but nonetheless illustrative, embodiments when taken in conjunction with the accompanying drawings.

In this respect, before explaining the current embodiments of the drain-unclogging straw in detail, it is to be understood that the drain-unclogging straw is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the drain-unclogging straw.

It is therefore important that the claims be regarded as including such equivalent construction insofar as they do not depart from the spirit and scope of the drain-unclogging straw. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
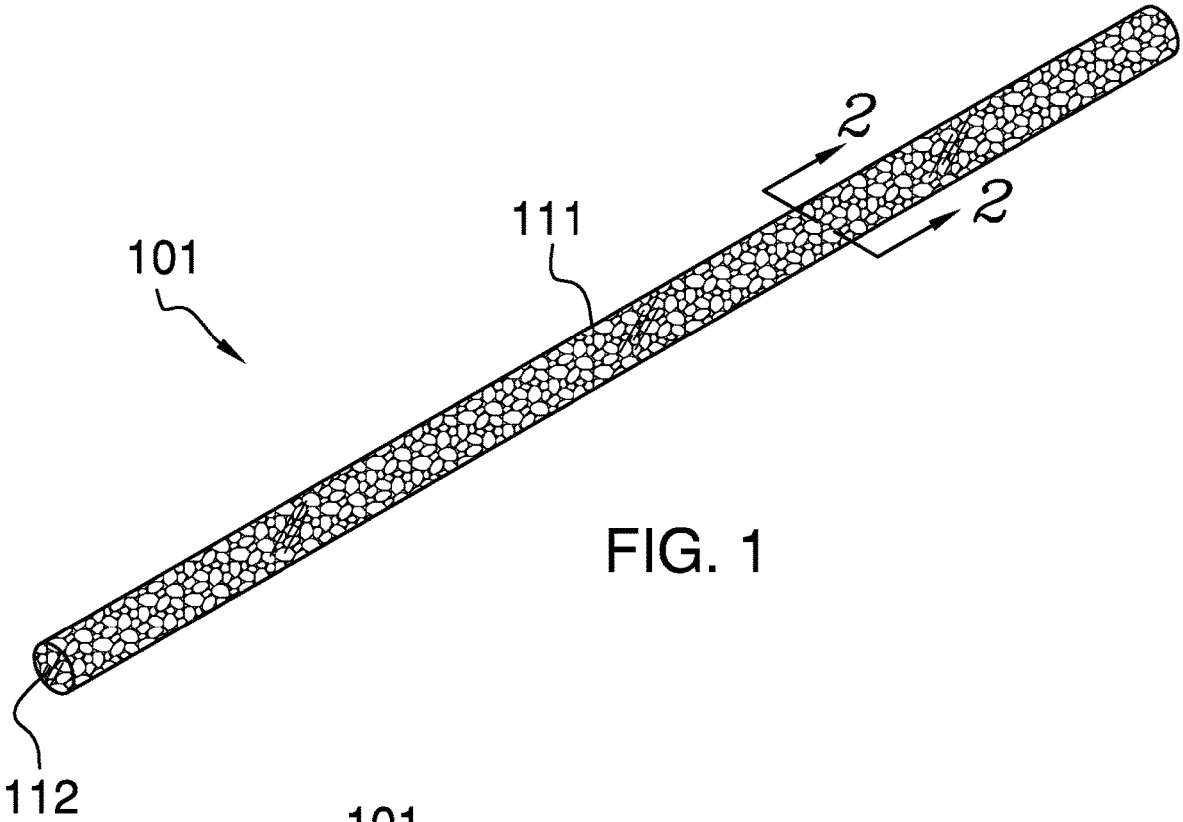
FIG. 1 is a perspective view of an embodiment of the disclosure.
Figure 2:
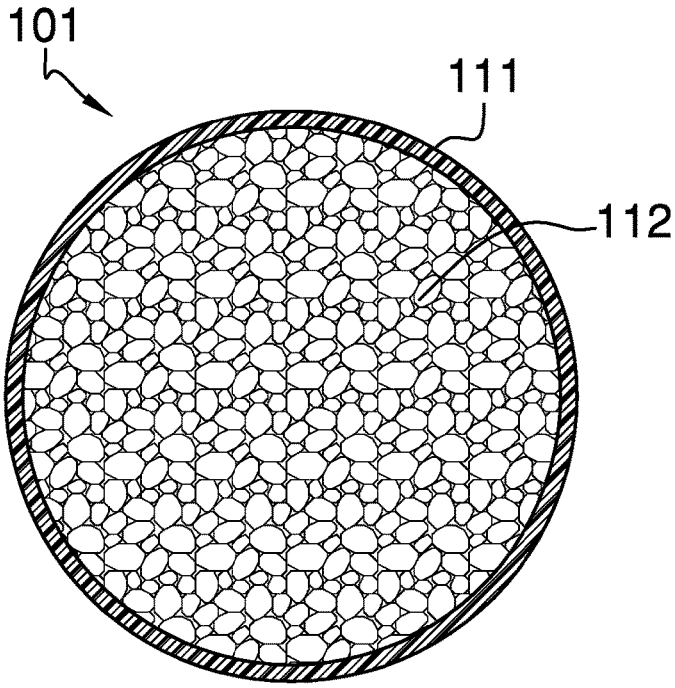
FIG. 2 is a cross-sectional view of an embodiment of the disclosure across 2-2 as shown in FIG. 1.
Figure 3:
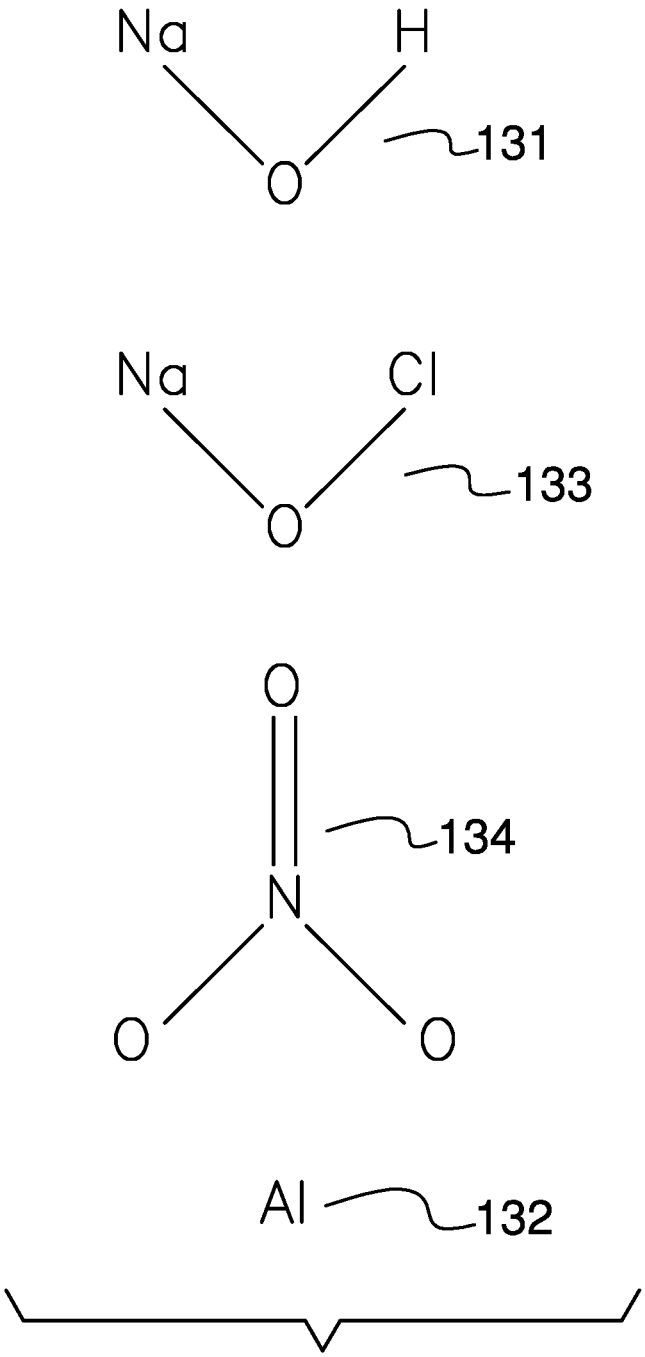
FIG. 3 is formula view of an embodiment of the disclosure.
Figure 4:
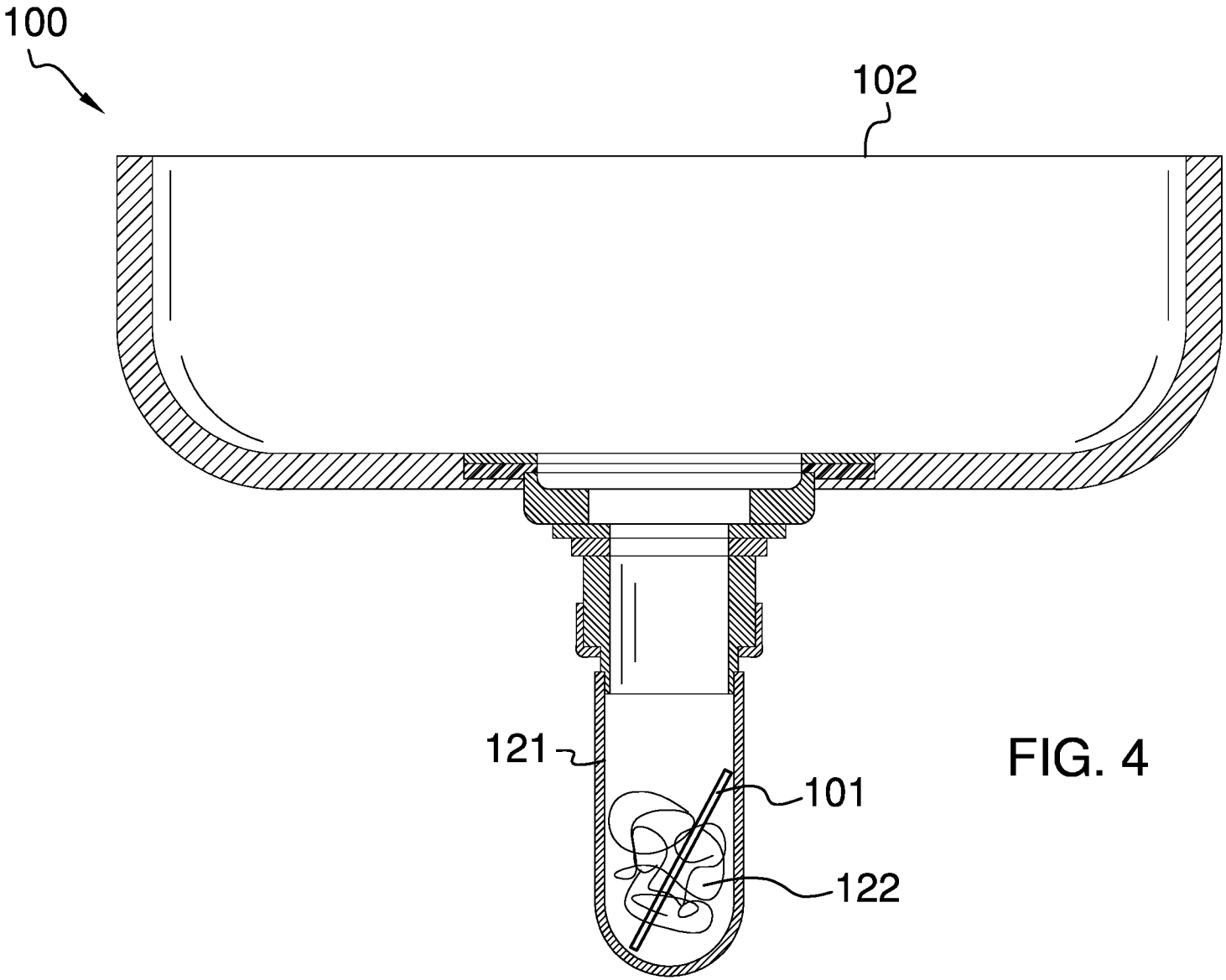
FIG. 4 is an in-use view of an embodiment of the disclosure.

Detailed reference will now be made to one or more potential embodiments of the disclosure, which are illustrated in FIGS. 1 through 4.

The drain 121 unclogging straw 100 (hereinafter invention) is a chemical device. The invention 100 comprises a drain 121 clearing device 101 and a domestic DWV system 102. The domestic DWV system 102 handles wastewater generated from domestic plumbing systems. The domestic DWV system 102 further comprises a drain 121. The drain 121 contains biochemically-generated material 122 that inhibits the flow of wastewater through the drain 121. The drain 121 clearing device 101 is a chemical device that is formed as a kit. The drain 121 clearing device 101 breaks the biochemically-generated material 122 down into components that will flow through the drain 121. The drain 121 clearing device 101 comprises a straw 111 and a chemical compound 112. The chemical compound 112 is in a solid phase. The straw 111 contains the chemical compound 112. The straw 111 is placed directly in the drain 121. Once in the drain 121, the straw 111 dissolves in water trapped in the drain 121 such that the chemical compound 112 is released into the drain 121. The chemical compound 112 chemically interacts with the biochemically-generated material 122 such that the biochemically-generated material 122 is broken down.

The domestic DWV system 102 is a drain 121 age, waste, and ventilation system of a residential plumbing system. This disclosure assumes that the domestic DWV system 102 is configured for use with biological eliminations and excretions. The domestic DWV system 102 further comprises a drain 121 and biochemically-generated material 122.

The drain 121 is a port into which wastewater, biological excretions, and biological eliminations are deposited for in preparation of introducing the excretions, eliminations, and wastewater into an externally provided wastewater handling system.

The biochemically-generated material 122 refers to a mass of biologically generated materials that have accumulated within the domestic DWV system 102. The biochemically-generated material 122 is primarily composed of lipids, proteins, and carbohydrates.

The drain 121 clearing device 101 comprises a straw 111 and a chemical compound 112.

The drain 121 clearing device 101 is a self-contained chemical kit. By self-contained chemical kit is meant that the chemical compound 112 is contained within the straw 111 such that the chemical compound 112 is not released until the straw 111 has been placed in the drain 121. The advantage of the kit structure of the drain 121 clearing device 101 is that the chemical compound 112 of the drain 121 clearing device 101 does not come in contact with biological structures until the straw 111 has dissolved in the drain 121.

The straw 111 is an enclosed structure. The straw 111 is a hollow structure. The straw 111 is a prism-shaped structure. The straw 111 contains the chemical compound 112 such that the straw 111 is isolated from the exterior environment of the straw 111. The straw 111 is a water-soluble structure such that the straw 111 dissolves when placed in contact with water. Specifically, the straw 111 dissolves when the placed in contact with water in the drain 121 such that the chemical compound 112 is released in the drain 121. In the first potential embodiment of the disclosure, the straw 111 is made from a water-soluble paper. Water-soluble paper is a commercially available product that is commonly marketed as "dissolving paper" and "spy paper."

The chemical compound 112 is a composition of matter formed as a mixture of compounds selected from the group consisting of molecular compounds and atoms. The chemical compound 112 chemically interacts with the biochemically-generated material 122 contained within the drain 121 such that the chemical compound 112 will break down the biochemically-generated material 122 into chemical structures that will flow within the drain 121. By breaking down the biochemically-generated material 122 into chemical structures that will flow within the drain 121 is meant that the chemical compound 112 will generated chemical reactions that will convert the biochemically-generated material 122 into water-soluble materials. By breaking down the biochemically-generated material 122 into chemical structures that will flow within the drain 121 is further meant that the chemical compound 112 will break the biochemically-generated material 122 into particulates of a size that can be carried by water flowing through the drain 121. The chemical compound 112 comprises a mixture of sodium hydroxide (CAS 1310-73-2) 131, aluminum powder (CAS 77446-70-0) 132, sodium hypochlorite (CAS 7681-52-9) 133, and sodium nitrate (CAS 7631-99-4) 134.

The sodium hydroxide 131 (CAS 1310-73-2) is a well-known and documented molecule. The sodium hydroxide 131 is an ionic compound with a molecular weight of 39.997 grams per mole. The sodium hydroxide 131 is stored in the straw 111 in a solid powder phase. The sodium hydroxide 131 disassociates in water to release hydroxyl anions into solution within the water in the drain 121. The sodium hydroxide 131 molecule is known to denature proteins. The sodium hydroxide 131 molecule is further known to disassociate proteins and carbohydrates. The sodium hydroxide 131 molecule is further known to react with lipids to create water-soluble molecules. This chemical process is similar to the processes used to create the fatty acids characteristic of soap.

The aluminum powder 132 (CAS 7429-90-5) is formed from the atom that forms element 13 in the periodic table. The aluminum powder 132 has an atomic weight of 26.98 grams per mole. The aluminum powder 132 is stored in the straw 111 in a solid powder phase. The primary purpose of the aluminum powder 132 is to generate an exothermic reaction proximal to the biochemically-generated material 122.

The heat generated by the exothermic reaction of the aluminum powder 132 with the sodium hydroxide 131 serves to enhance the chemical reactions between the chemical compound 112 and the biochemically-generated material 122. The heat generated by the exothermic reaction of the aluminum powder 132 with the sodium hydroxide 131 further serves to loosen any solidified structures within the biochemically-generated material 122.

The aluminum powder 132 remaining after the primary reaction with the sodium hydroxide 131 further serves as a surface catalyst that enhance the chemical reactions between the chemical compound 112 and the biochemically-generated material 122.

The sodium hypochlorite 133 (CAS 7681-52-9) is a well-known and documented molecule. The sodium hypochlorite 133 is an ionic compound with a molecular weight of 74.440 grams per mole. The sodium hypochlorite 133 is stored in the straw 111 in a solid powder phase. The sodium hypochlorite 133 disassociates in water to release hypochlorite anions into solution within the water in the drain 121. The primary purpose of the sodium hypochlorite 133 is to modulate the pH within the drain 121 during the chemical processes. The sodium hypochlorite 133 molecule further performs the identical chemical functions of the sodium hydroxide 131.

The sodium nitrate 134 (CAS 7631-99-4) is a well-known and documented molecule. The sodium nitrate 134 is an ionic compound with a molecular weight of 89.995 grams per mole. The sodium nitrate 134 is stored in the straw 111 in a solid powder phase. The sodium nitrate 134 disassociates in water to release nitrate cations into solution within the water in the drain 121. The primary purpose of the sodium nitrate 134 is to release nitrate cations into the drain 121. The nitrate cations released by the sodium nitrate 134 serve to denature proteins.

The following five paragraphs describe the composition of the chemical compound 112.

The mass of the sodium hydroxide 131 contained within the straw 111 is greater than or equal to 62.5% (m/m) of the mass of the chemical compound 112 contained within the straw 111. The mass of the sodium hydroxide 131 contained within the straw 111 is lesser than or equal to 76.3% (m/m) of the mass of the chemical compound 112 contained within the straw 111.

The mass of the aluminum powder 132 contained within the straw 111 is greater than or equal to 18.7% (m/m) of the mass of the chemical compound 112 contained within the straw 111. The mass of the aluminum powder 132 contained within the straw 111 is lesser than or equal to 25.7% (m/m) of the mass of the chemical compound 112 contained within the straw 111.

The mass of the sodium hypochlorite 133 contained within the straw 111 is greater than or equal to 0.1% (m/m) of the mass of the chemical compound 112 contained within the straw 111. The mass of the sodium hypochlorite 133 contained within the straw 111 is lesser than or equal to 3.2% (m/m) of the mass of the chemical compound 112 contained within the straw 111.

The mass of the sodium nitrate 134 contained within the straw 111 is greater than or equal to 0.1% (m/m) of the mass of the chemical compound 112 contained within the straw 111. The mass of the sodium nitrate 134 contained within the straw 111 is lesser than or equal to 4.7% (m/m) of the mass of the chemical compound 112 contained within the straw 111.

The applicant prefers that the mass of the sodium hydroxide 131 contained within the straw 111 equals 69.4% (m/m) of the mass of the chemical compound 112 contained within the straw 111. The applicant prefers that the mass of the aluminum powder 132 contained within the straw 111 equals 23.4% (m/m) of the mass of the chemical compound 112 contained within the straw 111. The applicant prefers that the mass of the sodium hypochlorite 133 contained within the straw 111 equals 2.9% (m/m) of the mass of the chemical compound 112 contained within the straw 111. The applicant prefers that the mass of the sodium nitrate 134 contained within the straw 111 equals 4.3% (m/m) of the mass of the chemical compound 112 contained within the straw 111.

The following definitions were used in this disclosure:

Aluminum: As used in this disclosure, aluminum is a metal. Aluminum (CAS 7429-90-5) is element 13 in the periodic table and has a designated abbreviation of Al.

Amino Acid: As used in this disclosure, an amino acid refers to a carbon atom that has a carboxyl functional group and an amine functional group. The standard amino acids refers to the twenty to twenty two-amino acids commonly used for biological functions. The range of twenty to twenty-two depends on the specific context: the first twenty amino acids refer to the amino acids that are incorporated into proteins using the normal biosynthetic process while two additional amino acids can be incorporated into proteins using alternate biological mechanisms.

Anion: As used in this disclosure, an anion refers to a negatively charged ion.

Atom: As used in this disclosure, an atom is the smallest single unit of an element.

Biochemistry: As used in this disclosure, biochemistry refers to the chemical substances and the chemical processes associated with biological processes.

Carbohydrate: As used in this disclosure, a carbohydrate refers to a polymer chain formed form sugar molecules. The chemical formula of carbohydrates takes the general form of Cx(H2O)x where x is a positive integer. Carbohydrates are often referred to as a starch.

Catalyst: As used in this disclosure, a catalyst is a chemical used to increase the rate of a chemical reaction. A catalyst remains unchanged after the completion of the chemical reaction.

Cation: As used in this disclosure, a cation refers to a positively charged ion.

Cellulose: As used in this disclosure, cellulose is an insoluble substance that is the main constituent of plant cell walls and vegetable fibers such as cotton. Chemically, cellulose is formed from a chain or individual glucose molecules.

Disassociate: As used in this disclosure, disassociate refers to a chemical process of breaking a molecule down into smaller molecular and atoms.

Dissolve: As used in this disclosure, to dissolve refers to the incorporation of a solute into a solvent to form a solution.

DWV: As used in this disclosure, DWV is an acronym for drainage, waste, and vent. With a residential plumbing system, DWV refers to the plumbing subnetwork that transports wastewater out of the residence to an appropriate wastewater handling system.

Fatty Acid: As used in this disclosure, a fatty acid refers to a carboxylic acid with a continuous carbon chain of greater than three carbon atoms beyond the carboxyl functional group.

Fluid: As used in this disclosure, a fluid refers to a state of matter wherein the matter is capable of flow and takes the shape of a container it is placed within. The term fluid commonly refers to a liquid or a gas.

Gas: As used in this disclosure, a gas refers to a state (phase) of matter that is fluid and that fills the volume of the structure that contains it. Stated differently, the volume of a gas always equals the volume of its container.

Hydroxyl: As used in this disclosure, a hydroxyl refers to a functional group comprising the chemical formulation OH. The hydroxyl is the primary functional group that forms alcohols. When unbound, the hydroxyl is considered an ion and is considered to be a radical.

Hypochlorite: As used in this disclosure, hypochlorite (CAS 14380-61-1) is a chemical compound with the formula $ClO^-$. Hypochlorite is commonly referred to as bleach.

Lipid: As used in this disclosure, a lipid is an organic molecule that is soluble in nonpolar solvents.

Liquid: As used in this disclosure, a liquid refers to a state (phase) of matter that is fluid and that maintains, for a given pressure, a fixed volume that is independent of the volume of the container.

Molecule: As used in this disclosure, a molecule refers to a plurality of atoms that are bonded together.

Organic: As used in this disclosure, organic refers to a carbon-based chemical structure. A limited number of (mostly) carbon-based salts are traditionally considered inorganic chemical structures and are excluded from the study of organic chemistry.

Paper: As used in this disclosure, paper refers to a sheeting material commonly used as: a) a substrate on which people write; b) a substrate on which images are displayed; and, c) wrapping items. Paper is typically made from plant fibers such as cellulose. Paper intend for specific purposes may be made from other materials.

Peptide: As used in this disclosure, a peptide is refers to a molecular sequence formed with one or more bonds between two or more amino acids. Unless otherwise stated in this disclosure, the amino acids are not limited to the standard amino acids.

Phase: As used in this disclosure, phase refers to the state of the form of matter. The common states of matter are solid, liquid, gas, and plasma.

Port: As used in this disclosure, a port is an opening formed in an object that allows fluid to flow through the boundary of the object.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Protein: As used in this disclosure, a protein refers to a linear molecular sequence of amino acids. Unless otherwise stated in this disclosure, a protein is exclusively formed from the standard amino acids.

Soap: As used in this disclosure, a soap is a cleaning chemical that is used in cleaning an object. Soap is generally formed from a mixture of one or more salts and one or more fatty acids.

Sodium: As used in this disclosure, sodium (CAS 7440-23-5) refers to the element with atomic number 11 in the periodic table. The standard abbreviation for sodium is Na.

Sodium Hydroxide: As used in this disclosure, sodium hydroxide (CAS 1310-73-2) refers to a chemical compound with the formula NaOH. Sodium hydroxide is often referred to as lye.

Sodium Hypochlorite: As used in this disclosure, sodium hypochlorite (CAS 7681-52-9) refers to a chemical compound with the formula. Sodium hypochlorite is commonly used in household bleaches.

Sodium Nitrate: As used in this disclosure, sodium nitrate (CAS 7631-99-4) refers to a chemical compound with the formula NaNO3.

Solid: As used in this disclosure, a solid refers to a state (phase) of matter that: 1) has a fixed volume; and, 2) does not flow.

Solution: As used in this disclosure, a solution is a uniform mixture of two or more compounds in a liquid phase. The major component selected of the solution selected from the two or more compounds is called the solvent. The components remaining in the two or more compounds are called the solute.

Tube: As used in this disclosure, the term tube is used to describe a rigid hollow prism with two open ends. While tubes that are suitable for use in this disclosure are often used to transport or conveys fluids or gases, the purpose of the tubes in this disclosure are structural. In this disclosure, the terms inner dimension and outer dimension of a tube are used as they would be used by those skilled in the plumbing arts.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A kit for clearing a domestic plumbing structure comprising:

a drain clearing device and a domestic DWV system;

wherein the kit for clearing a domestic plumbing structure is a chemical device;

wherein the domestic DWV system handles wastewater;

wherein the domestic DWV system further comprises a drain and biochemically-generated material;

wherein the drain contains the biochemically-generated material;

wherein the biochemically-generated material inhibits the flow of wastewater through the drain;

wherein the drain clearing device is a chemical device that is formed as a kit;

wherein the drain clearing device breaks the biochemically-generated material down into components that will flow through the drain;

wherein the biochemically-generated material comprises lipids, proteins, and carbohydrates;

wherein the drain clearing device comprises a straw and a chemical compound;

wherein the straw contains the chemical compound;

wherein the chemical compound comprises a mixture of sodium hydroxide, aluminum powder, sodium hypochlorite, and sodium nitrate;

wherein the sodium hydroxide is a molecule;

wherein the sodium hydroxide is an ionic compound;

wherein the sodium hydroxide has a molecular weight of 39.997 grams per mole;

wherein the aluminum powder is formed from the atom that forms element 13 in the periodic table;

wherein the aluminum powder has an atomic weight of 26;

wherein 98 grams per mole;

wherein the sodium hypochlorite is a molecule;

wherein the sodium hypochlorite is an ionic compound with a molecular weight of 74.440 grams per mole;

wherein the sodium nitrate is a molecule;

wherein the sodium nitrate is an ionic compound with a molecular weight of 89.995 grams per mole.

2. The kit for clearing a domestic plumbing structure according to claim 1 wherein the drain clearing device is a self-contained chemical kit;

wherein by self-contained chemical kit is meant that the chemical compound is contained within the straw such that the chemical compound is not released until the straw has been placed in the drain.

3. The kit for clearing a domestic plumbing structure according to claim 2 wherein the chemical compound is in a solid phase.

4. The kit for clearing a domestic plumbing structure according to claim 3 wherein the straw is placed directly in the drain;

wherein the straw dissolves in water trapped in the drain such that the chemical compound is released into the drain;

wherein the chemical compound chemically interacts with the biochemically-generated material such that the biochemically-generated material is broken down.

5. The kit for clearing a domestic plumbing structure according to claim 4 wherein the straw is an enclosed structure;

wherein the straw is a hollow structure;

wherein the straw is a prism-shaped structure.

6. The kit for clearing a domestic plumbing structure according to claim 5 wherein the straw is a water-soluble structure such that the straw dissolves when placed in contact with water.

7. The kit for clearing a domestic plumbing structure according to claim 6 wherein the straw is made from a water-soluble paper.

8. The kit for clearing a domestic plumbing structure according to claim 6 wherein the chemical compound is a composition of matter formed as a mixture of compounds selected from the group consisting of molecular compounds and atoms;

wherein the chemical compound chemically interacts with the biochemically-generated material contained within the drain such that the chemical compound will break down the biochemically-generated material into chemical structures that will flow within the drain;

wherein by breaking down the biochemically-generated material into chemical structures that will flow within the drain is meant that the chemical compound will generated chemical reactions that will convert the biochemically-generated material into water-soluble materials;

wherein by breaking down the biochemically-generated material into chemical structures that will flow within the drain is further meant that the chemical compound will break the biochemically-generated material into particulates.

9. The kit for clearing a domestic plumbing structure according to claim 8 wherein the straw is made from a water-soluble paper.

10. The kit for clearing a domestic plumbing structure according to claim 9 wherein the sodium hydroxide is stored in the straw in a solid powder phase;

wherein the aluminum powder is stored in the straw in a solid powder phase;

wherein the sodium hypochlorite is stored in the straw in a solid powder phase;

wherein the sodium nitrate is stored in the straw in a solid powder phase.

11. The kit for clearing a domestic plumbing structure according to claim 10 wherein the sodium hydroxide disassociates in water to release hydroxyl anions into solution within the water in the drain;

wherein the sodium hypochlorite disassociates in water to release hypochlorite anions into solution within the water in the drain;

wherein the sodium nitrate disassociates in water to release nitrate cations into solution within the water in the drain.

12. The kit for clearing a domestic plumbing structure according to claim 11 wherein the mass of the sodium hydroxide contained within the straw is greater than or equal to 62.5% (m/m) of the mass of the chemical compound contained within the straw;

wherein the mass of the aluminum powder contained within the straw is greater than or equal to 18.7% (m/m) of the mass of the chemical compound contained within the straw.

13. The kit for clearing a domestic plumbing structure according to claim 12 wherein the mass of the sodium hydroxide contained within the straw is lesser than or equal to 76.3% (m/m) of the mass of the chemical compound contained within the straw;

wherein the mass of the aluminum powder contained within the straw is lesser than or equal to 25.7% (m/m) of the mass of the chemical compound contained within the straw.

14. The kit for clearing a domestic plumbing structure according to claim 13 wherein the mass of the sodium hypochlorite contained within the straw is greater than or equal to 0.1% (m/m) of the mass of the chemical compound contained within the straw;

wherein the mass of the sodium hypochlorite contained within the straw is lesser than or equal to 3.2% (m/m) of the mass of the chemical compound contained within the straw.

15. The kit for clearing a domestic plumbing structure according to claim 14 wherein the mass of the sodium nitrate contained within the straw is greater than or equal to 0.1% (m/m) of the mass of the chemical compound contained within the straw;

wherein the mass of the sodium nitrate contained within the straw is lesser than or equal to 4.7% (m/m) of the mass of the chemical compound contained within the straw.

16. The kit for clearing a domestic plumbing structure according to claim 15 wherein the straw is made from a water-soluble paper.

17. The kit for clearing a domestic plumbing structure according to claim 16 wherein the mass of the sodium hydroxide contained within the straw equals 69.4% (m/m) of the mass of the chemical compound contained within the straw;

wherein the mass of the aluminum powder contained within the straw equals 23.4% (m/m) of the mass of the chemical compound contained within the straw;

wherein the mass of the sodium hypochlorite contained within the straw equals 2.9% (m/m) of the mass of the chemical compound contained within the straw;

wherein the mass of the sodium nitrate contained within the straw equals 4.3% (m/m) of the mass of the chemical compound contained within the straw.

* * * * *